US007607187B2

(12) United States Patent
Vargas

(10) Patent No.: US 7,607,187 B2
(45) Date of Patent: Oct. 27, 2009

(54) ONE STEP COPPER PIPE FITTING ABRASION PREPARATION

(76) Inventor: Steven Joseph Vargas, 7 Price Rd. West, Santa Fe, NM (US) 87507

( * ) Notice: Subject to any disclaimer, the term of this patent is extended or adjusted under 35 U.S.C. 154(b) by 0 days.

(21) Appl. No.: 12/378,972

(22) Filed: Feb. 21, 2009

(65) Prior Publication Data

US 2009/0209178 A1 Aug. 20, 2009

Related U.S. Application Data

(63) Continuation-in-part of application No. 11/174,635, filed on Jul. 6, 2005.

(51) Int. Cl.
*B24B 1/00* (2006.01)
*B08B 9/023* (2006.01)

(52) U.S. Cl. ..... 15/104.03; 15/104.02; 15/104.095

(58) Field of Classification Search ..... 15/104.02, 15/104.03, 104.04, 104.05, 104.095; 451/51
See application file for complete search history.

(56) References Cited

U.S. PATENT DOCUMENTS 4,575,892 A * 3/1986 Ross ..... 15/106
4,600,444 A * 7/1986 Miner ..... 134/8
4,862,549 A * 9/1989 Criswell et al. ..... 15/104.04
5,038,525 A * 8/1991 Gardner ..... 451/439
5,099,537 A * 3/1992 Denny ..... 15/88
5,157,802 A * 10/1992 Guidry et al. ..... 15/88
5,307,534 A * 5/1994 Miller ..... 15/4
5,493,748 A * 2/1996 Santo ..... 15/104.04
6,065,173 A * 5/2000 White ..... 15/88
6,106,370 A * 8/2000 Carter ..... 451/51
6,393,645 B1 * 5/2002 Kadinger ..... 15/104.04
6,964,077 B2 * 11/2005 Kadinger et al. ..... 15/104.03

* cited by examiner

*Primary Examiner*—Shay L Karls
(74) *Attorney, Agent, or Firm*—Walter A. Michel

(57) ABSTRACT

A method for abrading or polishing and reaming the terminal ends of tubing or fittings using a hand-held electrically powered device having a rotating member capable of accepting a standard shaft which has attached to it a male and female abrasive member which will polish or abrade the inside and outside of a length tubing or fitting respectively uses the same tool. Also attached to the standard shaft is a reamer for removing unwanted material from the end of the length of tubing. All of these members are attached at the same end of the standard shaft, thereby allowing all the operations to be performed at one time on each tubing or mating fitting member. In addition, the standard shaft may be connected to a clutch release mechanism allowing the tool mechanism to disengage upon the application of excessive torque.

19 Claims, 6 Drawing Sheets

ONE STEP COPPER PIPE FITTING ABRASION PREPARATION

This is a continuation in part of application Ser. No. 11/174,635 filed on Jul. 6, 2005.

FIELD OF THE INVENTION

This invention relates to a method for cleaning and/or polishing the inside and outside of metal pipes in preparation for soldering. This invention also includes a method for reaming the ends of pipes thereby removing any burrs, which are the result of cutting. Finally, this invention describes a method for performing all these functions in one operation and the capability of accommodating many sizes of pipes.

BACKGROUND ART

It is extremely important that copper pipes and copper fittings be free from any foreign matter, dirt, etc. prior to fitting two pipes together in a secure and waterproof joint. This is normally accomplished by abrading or polishing the inside of the pipe or pipe fitting and then performing the same abrasion or polishing of the outside of the pipe or pipe fitting in two separate operations. Finally, it is necessary to remove the burrs left from the cutting of the copper pipe in yet another operation. Many attempts have been made at accomplishing these functions in various configurations of tools. However, none have been able to accomplish all these operations in one simple step until now.

The patents described below (which appear in chronological order) illustrate various attempts at cleaning pipes, however, only one comes even close to combining these operations. That is U.S. Pat. No. 5,307,534 by Miller and issued on May 3, 1994.

For example U.S. Pat. No. 4,575,892 discloses a multiple of brushes called abrasion members for cleaning a multiple of male and female electrical conductors such as used in a car to trailer electrical connection. Male and female cleaning brushes being at opposite ends of the main tool body.

U.S. Pat. No. 4,600,444 discloses a permanently mounted (not portable) device for cleaning pipe and tubing whereby the pipes or tubing are of substantially equal length and can be cleaned at both ends simultaneously, both inside and outside, and the distance between the opposite ends can vary between 18" and 24" from end of pipe.

U.S. Pat. No. 4,862,549 discloses only a hard bristle brush for abrading the Inside and the outside of a pipe at the same time from the same end of a tool. The brush for cleaning the inside extends forward of the other brush and the bristles are of hard drawn carbon steel wires. The inner brush being attached to the shell by various means such as brazing or adhesive bonding, etc. while the outer shell can be of various materials.

U.S. Pat. No. 5,038,525 discloses a fixture to be mounted on an electric drill. Said fixture incorporates a mechanism that holds the pipe captive while the cleaning and reaming operation take place. This mechanism only allows cleaning of the outside of the pipe with an abrasive continuous pad and a mounted reamer. U.S. Pat. No. 5,099,537 discloses a combination cleaner and reamer for cleaning tubes and fittings which includes a base plate housing for accommodating multiple brushes for both internal and external cleaning and is designed to be mounted on and powered by an electric drill.

U.S. Pat. No. 5,157,802 discloses a stationary device, not portable, for cleaning pipes with brushes and high-powered cleaning fluid from jets. This patent is aimed toward cleaning pipes at petroleum related sites.

U.S. Pat. No. 5,307,534 discloses a handheld tool with bristle brushes at either end and including a reamer at the end with the brush for cleaning the outside of the pipe.

U.S. Pat. No. 5,493,748 discloses brushes, which are to be used in conjunction with an electric drill. This disclosure only allows for the use of one brush at a time, either for cleaning the interior or cleaning the exterior of a pipe.

U.S. Pat. No. 6,065,173 discloses a bench mounted device with two separate motors. One for cleaning the interior and the other for the exterior of a pipe. Automatic turn on when the pipe is inserted over the brush assembly or inside the brush assembly.

U.S. Pat. No. 6,106,370 discloses a fixed device, rather than portable for cleaning the outside of a pipe with abrasive pads rather than bristle brushes and includes a reamer at the end of the pipe. Also includes a method for performing these tasks.

U.S. Pat. No. 6,393,645 discloses only the twisted steel brush assembly to be used with a power drill. The brush for cleaning the inside is retractable within the assembly and the brush for cleaning the outside can then be used. Thereby allowing only one operation at a time.

BRIEF SUMMARY OF THE INVENTION

It is an object of this invention to provide a method that is used in the preparation of cleaning copper pipe and its connecting fittings for soldering the pieces together. The cleaning of both the inside of the copper fitting and the inside and outside of a copper pipe as well as de-burring the end of the copper pipe can all be done at one time, thereby reducing the time required and increasing the efficiency of the operation.

DETAILED DESCRIPTION OF THE INVENTION

Figure 1:
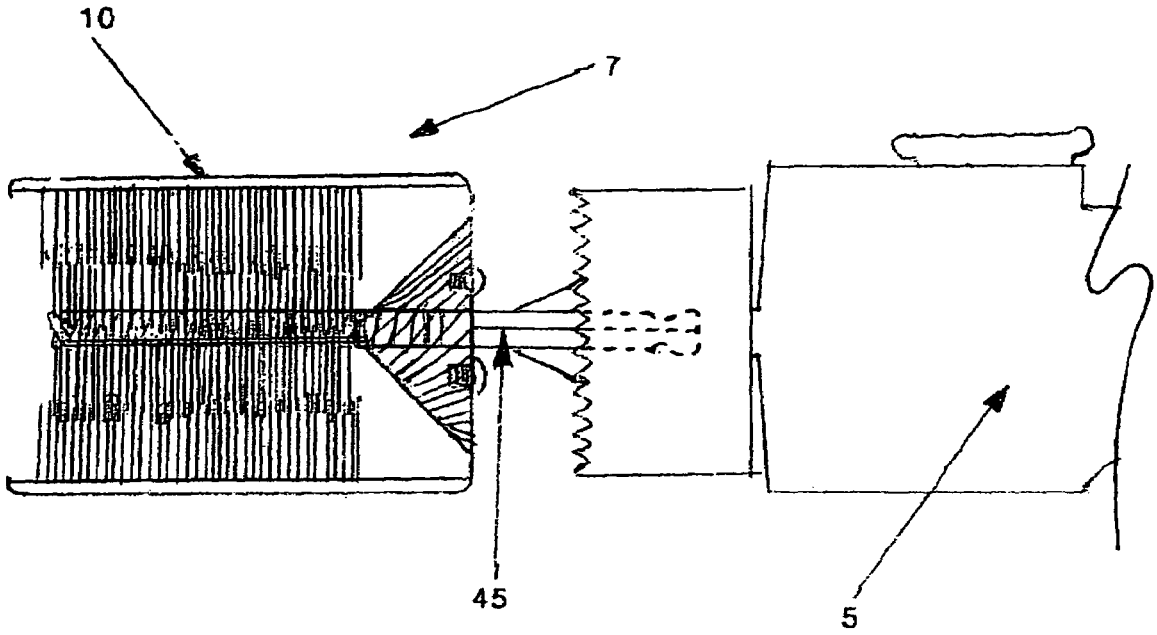
FIG. 1. is an overall view of the tube polishing or abrading apparatus showing attachment to a rotating mechanism.
Figure 2:
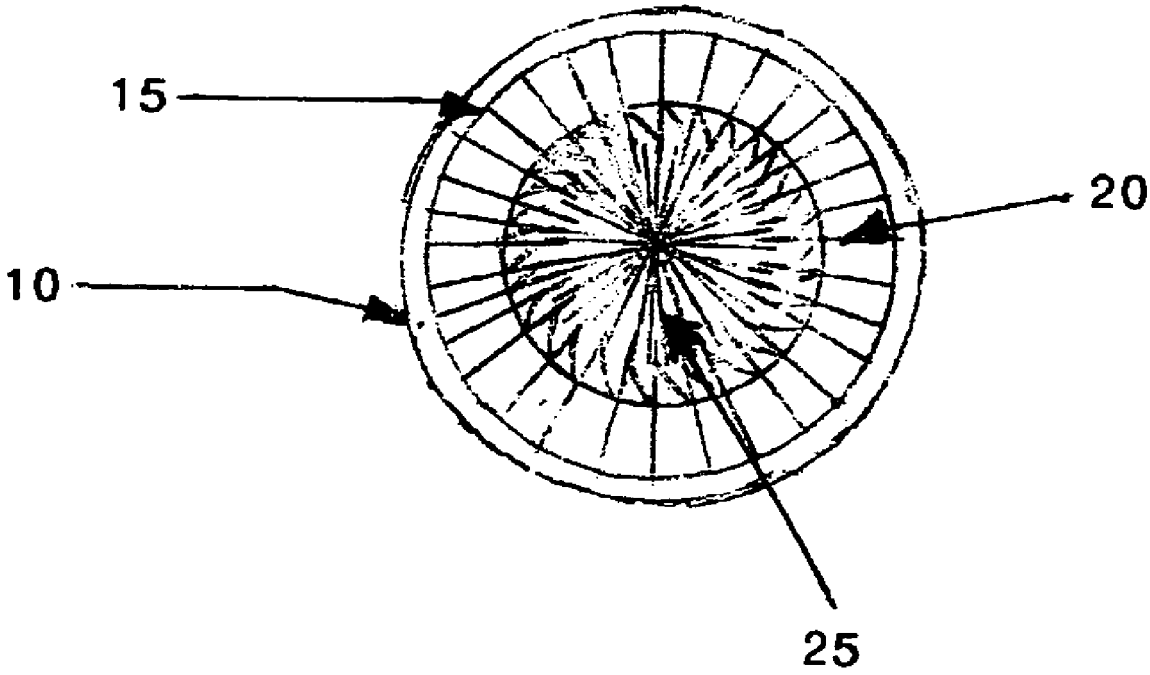
FIG. 2. is a front view of the tube polishing or abrading apparatus.
Figure 3:
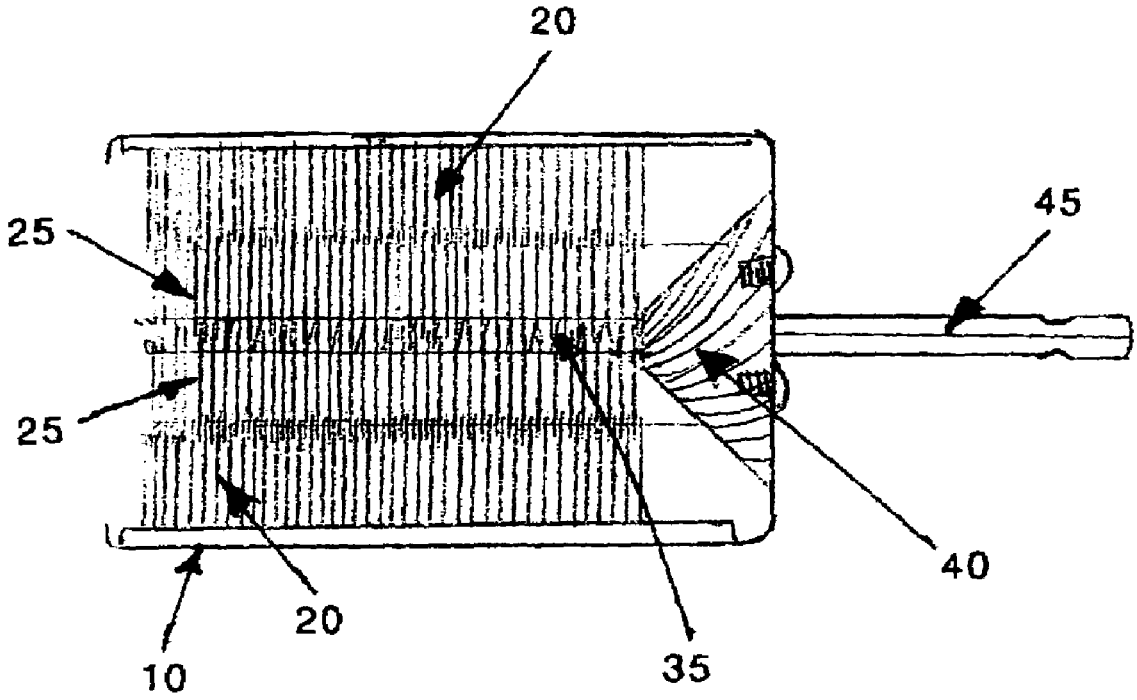
FIG. 3. is a side view of the tube polishing or abrading apparatus.
Figure 4:
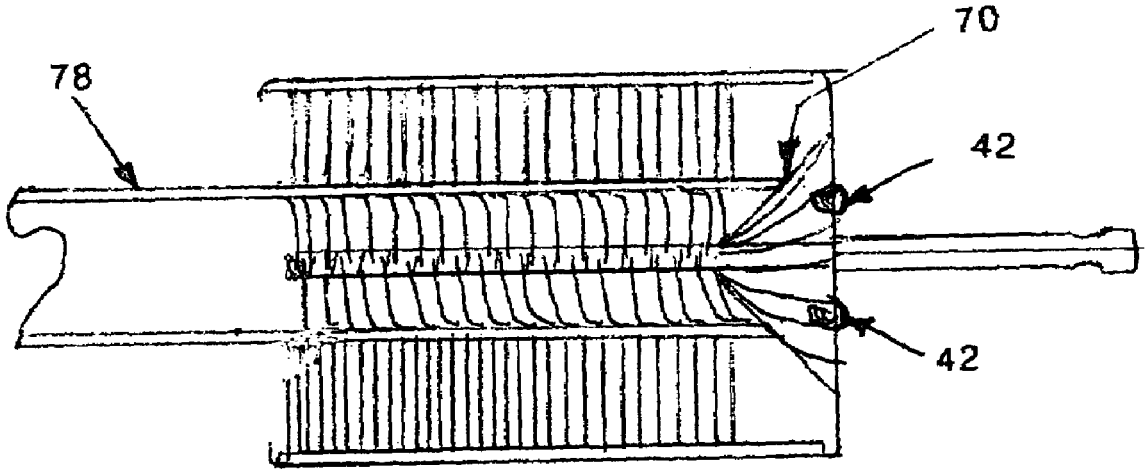
FIG. 4. is a side view of the tube polishing or abrading apparatus showing engagement with a length of tubing.
Figure 5:
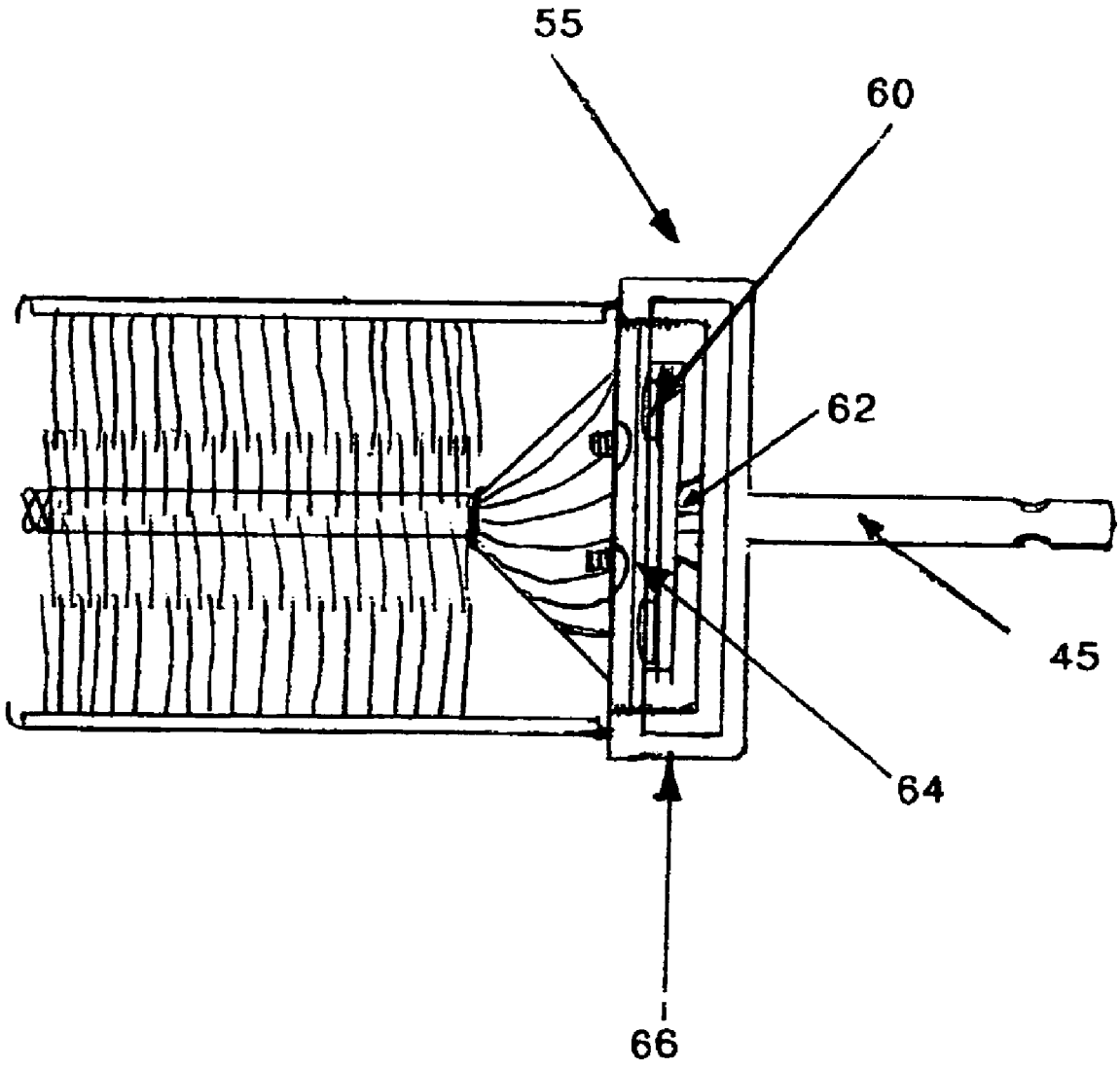
FIG. 5. is a side view of the tube polishing or abrading apparatus illustrating the addition of a torque control clutch.
Figure 6:
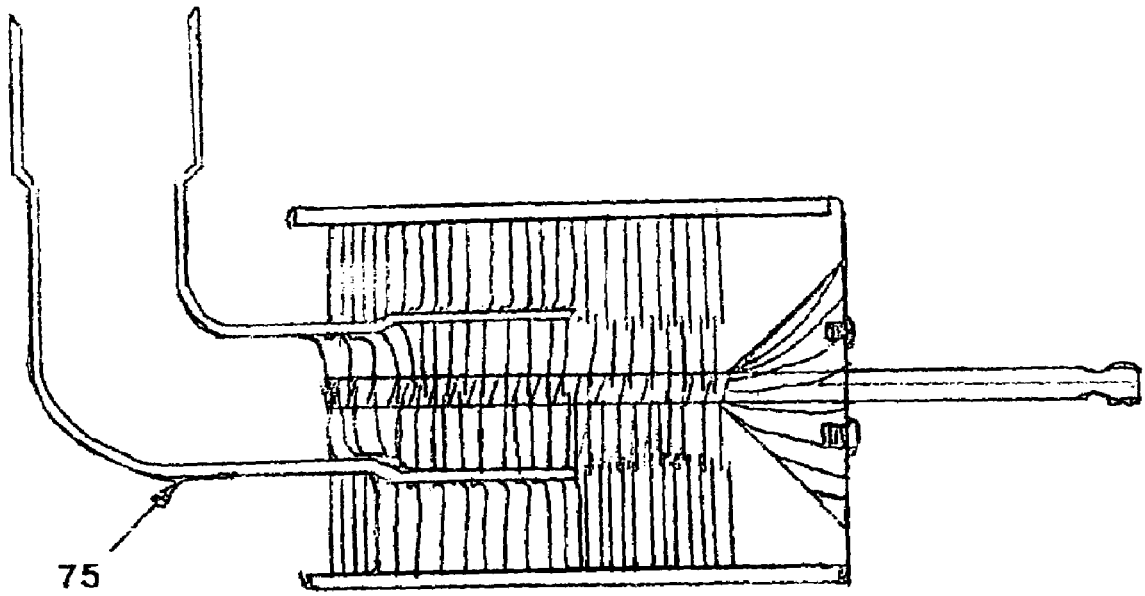
FIG. 6. is a side view of the tube polishing or abrading apparatus showing the engagement of a copper fitting that mates with the tubing shown in FIG. 4.

As shown in FIG. 1, a rotating mechanism (5) is attached to a tool (7) which is made up of a housing (10) and a connecting shaft (45). The front view of FIG. 2 shows the housing (10) which contains a first mass of inwardly facing wire bristles attached on the inner-side of the housing to a bristle binder (15) and referred to as the female abrading member (20). A second mass of outwardly facing wire bristles, referred to as the male abrading member (25) are shown inwardly of the female abrading member (20). In FIG. 3 it can be seen that the male abrading member (25) is connected to a hexagonal shaft (35) that is centered in the housing (10) overlapping the female abrading member (20) by approximately 1/16". One end of the hexagonal shaft (35) is centrally attached to an octagon shaft (45) which will mate with a rotating mechanism (5) or a standard cordless drill as shown in FIG. 1. At the end of the hexagonal shaft (35) which mates with octagon shaft (45) is a reamer (40), mounted by means of set screws (42) or any other convenient means, that will remove the burrs from an end (70) of copper tubing (78) with a slight inwardly push of said tubing (78), as shown in FIG. 4. This method will work for both the fittings and the pipe that are of the same size and includes sizes that will accommodate diameters from ⅜" upward of copper tubing. The flexible bristles that overlap each other are by necessity of slightly different diameters in order to fit within one another and the same method prepares the inside diameter surface and the outside diameter surface of the copper tubing in one operation. The method is versatile with most ⅜" hand driven cordless drills but can also include the steps of adding a clutch driven driver (55) as shown in FIG. 5 which comprises a hand twist clutch adjustment (66), a flywheel with bearing grooves (64), a pressure plate (62) and bearings (60).

Although the invention has been described by reference to some embodiments, it is not intended that the novel method for abrading or polishing and reaming the terminal ends of tubing be limited thereby, but that modifications thereof are intended to be included as falling within the broad spirit and scope of the foregoing disclosure, the following claims and the appended drawings.

What is claimed is:

1. A method for combining the steps of abrading or polishing and reaming terminal ends of tubing and fittings in one operation performed by a tool, in order for the tubing to be abraded and reamed to permit subsequent joining of the tubing to a like abraded and reamed fitting to form a continuous length of tubing wherein a hand-held electrically powered device having a rotating extension capable of accepting a shaft comprises the steps of;

a. concentrically connecting a male abrasive member to said shaft;

b. concentrically connecting a female abrasive member to an outer circumferential housing which encompasses the tool;

c. attaching said outer circumferential housing to said shaft;

d. attaching a reaming device to said shaft;

e. connecting said shaft to said rotating extension of said hand-held electrically powered device wherein the following steps are performed in one operation;

1. rotatably and abrasively engaging an inner surface of an end of a length of tubing or fitting;

2. rotatably and abrasively engaging an outer surface of the end of a length of tubing or fitting and 3. rotatably and abrasively engaging said reaming device for removing unwanted material from the end of a length of tubing or fitting.

2. The method of claim 1 wherein said female abrasive members, said male abrasive members and said reaming device comprise the step of rotatably and concentrically connecting to each other at an end opposite the entry point of the length of tubing or fitting.

3. The method of claim 1 wherein the female abrasive members comprise the step of attaching to the aforesaid outer circumferential housing by various bonding means.

4. The method of claim 1 wherein the outer circumferential housing comprises the step of attaching to the aforesaid shaft by various bonding means.

5. The method of claim 1 wherein the male abrasive members comprise the step of attaching to the aforesaid shaft by various bonding means.

6. The method of claim 1 wherein the reaming device comprises the step of attaching to the aforesaid shaft by various bonding means.

7. A method for combining the steps of abrading or polishing and reaming terminal ends of tubing and fittings in one operation preformed by a tool, in order for the tubing to be abraded and reamed to permit subsequent joining of the tubing to a like abraded and reamed fitting to form a continuous length of tubing wherein a hand-held electrically powered device having a rotating extension capable of accepting a shaft comprises the steps of;

a. concentrically connecting a male abrasive member to a second shaft;

b. concentrically connecting a female abrasive member to an outer circumferential housing which encompasses the tool;

c. attaching said outer circumferential housing to said second shaft;

d. attaching a reaming device to said second shaft;

e. concentrically attaching said second shaft to said shaft and f. connecting said shaft to said rotating extension of said hand-held electrically powered device wherein the following steps are performed in one operation;

1. rotatably and abrasively engaging an inner surface of an end of a length of tubing or fitting;

2. rotatably and abrasively engaging an outer surface of the end of a length of tubing or fitting and 3. rotatably and abrasively engaging said reaming device for removing unwanted material from the end of a length of tubing or fitting.

8. The method of claim 7 wherein said female abrasive members, said mate abrasive members and said reaming device comprise the step of rotatably and concentrically connecting to each other at an end opposite the entry point of the length of tubing or fitting.

9. The method of claim 7 wherein the female abrasive members comprise the step of attaching to the aforesaid outer circumferential housing by various bonding means.

10. The method of claim 7 wherein the outer circumferential housing comprises the step of attaching to the aforesaid second shaft by various bonding means.

11. The method of claim 7 wherein the male abrasive members comprise the step of attaching to the aforesaid second shaft by various bonding means.

12. The method of claim 7 wherein the reaming device comprises the step of attaching to the aforesaid second shaft by various bonding means.

13. A method for combining the steps of abrading or polishing and reaming terminal ends of tubing and fittings in one operation performed by a tool, in order for the tubing to be abraded and reamed to permit subsequent joining of the tubing to a like abraded and reamed fitting to form a continuous length of tubing wherein a hand-held electrically powered device having a rotating extension capable of accepting a shaft comprises the steps of;

a. concentrically connecting a clutch release mechanism to disengage upon the application of excessive torque to said second shaft;

b. concentrically connecting a male abrasive member to a second shaft;

c. concentrically connecting a female abrasive member to an outer circumferential housing which encompasses the tool;

d. attaching said outer circumferential housing to said second shaft;

e. attaching a reaming device to said second shaft;

f. concentrically attaching said second shaft to said shaft and g. connecting said shaft to said rotating extension of said hand-held electrically powered device wherein the following steps are performed in one operation;

1. rotatably and abrasively engaging an inner surface of an end of a length of tubing or fitting;
2. rotatably and abrasively engaging an outer surface of the end of a length of tubing or fitting and
3. rotatably and abrasively engaging said reaming device for removing unwanted material from the end of a length of tubing or fitting.

14. The method of claim 13 wherein said female abrasive members, said male abrasive members, said reaming device and said clutch release mechanism comprise the step of rotatably and concentrically connecting to each other at an end opposite the entry point of the length of tubing or fitting.

15. The method of claim 13 wherein the clutch release mechanism comprises the step of attaching to the second shaft by various bonding means.

16. The method of claim 13 wherein the female abrasive members comprise the step of attaching to the aforesaid outer circumferential housing by various bonding means.

17. The method of claim 13 wherein the outer circumferential housing comprises the step of attaching to the aforesaid second shaft by various bonding means.

18. The method of claim 13 wherein the male abrasive members comprise the step of attaching to the aforesaid second shaft by various bonding means.

19. The method of claim 13 wherein the reaming device comprises the step of attaching to the aforesaid second shaft by various bonding means.

* * * * *